US009302683B2

(12) United States Patent
Matsumoto et al.

(10) Patent No.: US 9,302,683 B2
(45) Date of Patent: Apr. 5, 2016

(54) RAILCAR

(71) Applicant: KAWASAKI JUKOGYO KABUSHIKI KAISHA, Kobe-shi, Hyogo (JP)

(72) Inventors: Mitsuhiro Matsumoto, Kobe (JP); Akihiko Tada, Kobe (JP)

(73) Assignee: KAWASAKI JUKOGYO KABUSHIKI KAISHA, Kobe (JP)

( * ) Notice: Subject to any disclaimer, the term of this patent is extended or adjusted under 35 U.S.C. 154(b) by 0 days.

(21) Appl. No.: 14/388,962

(22) PCT Filed: Mar. 26, 2013

(86) PCT No.: PCT/JP2013/002054

§ 371 (c)(1),
(2) Date: Sep. 29, 2014

(87) PCT Pub. No.: WO2013/145722

PCT Pub. Date: Oct. 3, 2013

(65) Prior Publication Data

US 2015/0040795 A1 Feb. 12, 2015

(30) Foreign Application Priority Data

Mar. 28, 2012 (JP) ..... 2012-074747

(51) Int. Cl.
*B61C 17/04* (2006.01)
*B61D 17/04* (2006.01)
*B61D 17/06* (2006.01)

(52) U.S. Cl.
CPC ..... *B61C 17/04* (2013.01); *B61D 17/046* (2013.01); *B61D 17/06* (2013.01)

(58) Field of Classification Search
CPC ..... B61D 27/00; B61D 17/00; B61C 17/04
See application file for complete search history.

(56) References Cited

U.S. PATENT DOCUMENTS

2003/0221584 A1* 12/2003 Huss et al. ..... 105/396
2013/0180277 A1* 7/2013 Uto et al. ..... 62/239

(Continued)

FOREIGN PATENT DOCUMENTS

CN 1681696 A 10/2005
CN 102358299 A 2/2012

(Continued)

OTHER PUBLICATIONS

Oct. 1, 2014 International Preliminary Report on Patentability issued in International Application No. PCT/JP2013/002054 (with English translation).

(Continued)

*Primary Examiner* — Jason C Smith
(74) *Attorney, Agent, or Firm* — Oliff PLC

(57) ABSTRACT

A railcar is a railcar including a driver's cab. One of both railcar-width-direction portions of the driver's cab is formed by a first driver's cab device unit. The first driver's cab device unit includes: a plurality of first driver's cab devices distributedly arranged in a plurality of areas located at one of both railcar-width-direction sides of the driver's cab; a first driver's cab device wire that connects the first driver's cab devices located in the different areas to one another; and a first driver's cab floor surface plate, a first driver's cab side plate, a first driver's cab back plate, and a first driver's cab ceiling plate, which form a part of an outer body of the driver's cab, the part being located at the one of both railcar-width-direction sides of the driver's cab. These components of the first driver's cab device unit are integrated to form a box shape.

7 Claims, 2 Drawing Sheets

(56) References Cited

U.S. PATENT DOCUMENTS

| | | | | |
|---|---|---|---|---|
| 2015/0040795 | A1* | 2/2015 | Matsumoto et al. | 105/456 |
| 2015/0059613 | A1* | 3/2015 | Matsumoto et al. | 105/396 |
| 2015/0059614 | A1* | 3/2015 | Matsumoto et al. | 105/456 |

FOREIGN PATENT DOCUMENTS

| | | | |
|---|---|---|---|
| EP | 0 836 976 | A1 | 4/1998 |
| EP | 0888946 | A1 | 1/1999 |
| EP | 0891909 | A1 | 1/1999 |
| EP | 2412599 | A1 | 2/2012 |
| FR | 2952339 | A1 | 5/2011 |
| HK | 1019723 | A1 | 2/2000 |
| JP | A-50-86013 | | 11/1975 |
| JP | A-09-076905 | | 3/1997 |
| JP | A-11-334589 | | 12/1999 |
| JP | A-2001-151108 | | 6/2001 |
| JP | A-2002-029418 | | 1/2002 |
| JP | A-2004-034971 | | 2/2004 |
| JP | A-2005-125998 | | 5/2005 |
| KR | 10-2011-0005957 | A | 1/2011 |
| KR | 101064273 | B1 | 9/2011 |

OTHER PUBLICATIONS

Jul. 2, 2013 International Search Report issued in International Application No. PCT/JP2013/002054.

Jan. 23, 2015 Office Action issued in Chinese Application No. 2013800081801.

Jan. 26, 2015 Office Action issued in Taiwanese Application No. 102111035.

Nov. 3, 2015 Extended Search Report issued in European Patent Application No. 13768886.7.

* cited by examiner

RAILCAR

TECHNICAL FIELD

The present invention relates to the structure of a railcar including a driver's cab.

BACKGROUND ART

A large number of devices are arranged in as limited space of a driver's cab of a railcar. For example, in the case of the driver's cab including a passage located at as middle portion thereof, the devices are arranged at not only a driver's platform provided at a front side of one of both railcar-width-direction sides sandwiching the passage and a driver's platform provided at a front side of the other railcar-width-direction side but also a wall surface and ceiling of a driver's seat side. Further, some of the devices are connected to one another by electric wires for signal transmission and reception. Connecting work for coupling the devices to each other is conventionally performed by a procedure including the steps of: laying the wires behind the wall surface of the driver's cab; attaching the devices to the drivers cab; and connecting the wires to the devices. However, since these steps cannot be performed concurrently, this procedure extremely takes time, and this has been cause to delay manufacturing steps of an entire manufacturing line.

When manufacturing railcars, a construction method that is called a unit construction method (module construction method) is adopted in some cases. According to this unit construction method, a part of the railcar is manufactured as a unit (module) at a place outside the railcar, and then the unit is carried in the railcar and attached to at pre-determined position. There are PTL1 and PTL 2 as literatures related to the unit construction method. Each of PTL 1 and PTL 2 discloses a railcar manufacturing method of carrying a unitized rig (equipment) in the railcar and attaching the unitized rig to the railcar. According to each of PTL1 and PTL2, this method can improve the work efficiency. However, PTL1 and PTL2 do not describe the unit construction method for the driver's cab.

CITATION LIST

Patent Literature

PTL 1: Japanese Laid-Open Patent Application Publication No 9-76905

PTL 2: Japanese Laid-Open Patent Application Publication No 2002-29418

SUMMARY OF INVENTION

Technical Problem

In the case of the driver's cab, not only the arranging work of the devices but also the connecting work of the wires requires a large amount of time. Especially, the connecting work of connecting the devices located at different areas to one another by the electric wires requires so much effort. Therefore, even in a case where the driver's cab is just partially manufactured as a unit, the connecting work of connecting different units to each other needs to be performed inside the railcar. On this account, the connecting work that delays the manufacturing steps does not decrease. The present invention was made in view of the above circumstances, and an object of the present invention is to provide a railcar including a driver's cab by which wire connecting work performed inside the railcar is reduced.

Solution to Problem

A railcar according to one aspect of the present invention is a railcar including as driver's cab, wherein: one of both railcar-width-direction portions of the driver's cab is formed by a first driver's cab device unit; the first driver's cab device, unit includes a plurality of first driver's cab devices distributedly arranged in a plurality of areas located at one of both railcar-width-direction sides of the driver's cab, a first driver's cab device wire that connects the first driver's cab devices located in the different areas to one another, and a first driver's cab floor surface plate, a first driver's cab side plate, a first driver's cab back plate, and a first driver's cab ceiling plate, which form a part of an outer body of the driver's cab, the part being located at the one of both railcar-width-direction skies of the driver's cab; and these components of the first driver's cab device unit are integrated, to form a box shape.

The first driver's cab device unit configured as above includes a part of the outer body of the driver's cab. This part of the outer body is also a portion to which the first driver's cab device wire is attached. Therefore, according to this configuration, the first driver's cab device wire can be included in the first driver's cab device unit, and the connecting work of the first driver's cab device wire can be performed outside the railcar.

Advantageous Effects of Invention

As above, according to the present invention, since the connecting work of the first driver's cab device wire can be performed outside the railcar, the wire connecting work performed inside the railcar can be reduced.

DESCRIPTION OF EMBODIMENTS

Hereinafter, an embodiment will be explained in reference to the drawings. In the following explanations and drawings, the same reference signs are used for the same or corresponding components, and a repetition of the same explanation is avoided.

Figure 1:
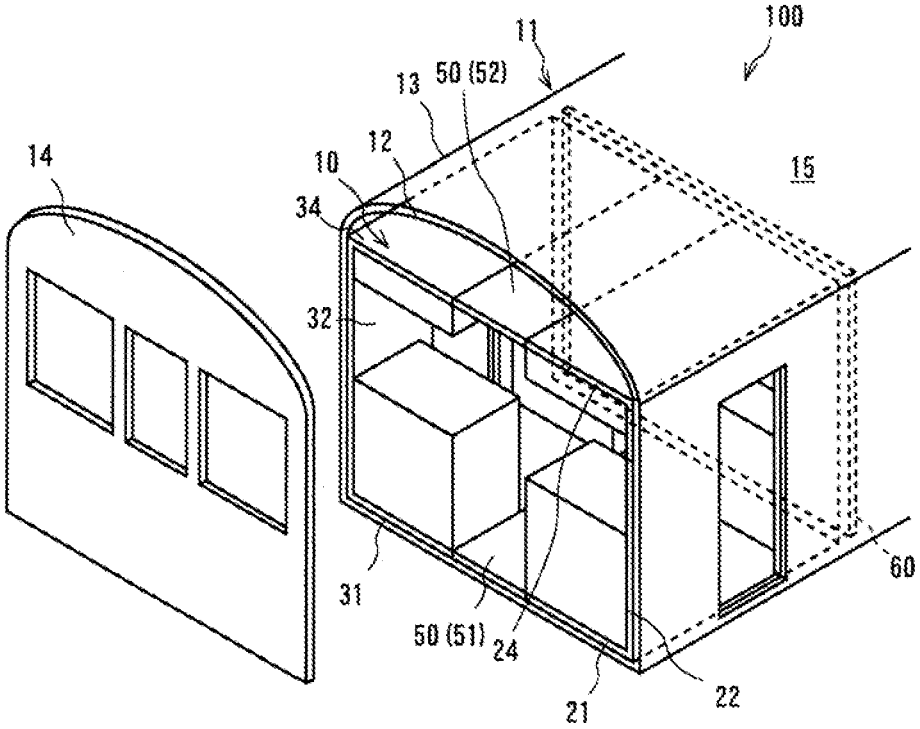
FIG. 1 is a partially exploded perspective view showing the vicinity of a driver's cab of a railcar according to an embodiment.
Figure 2:
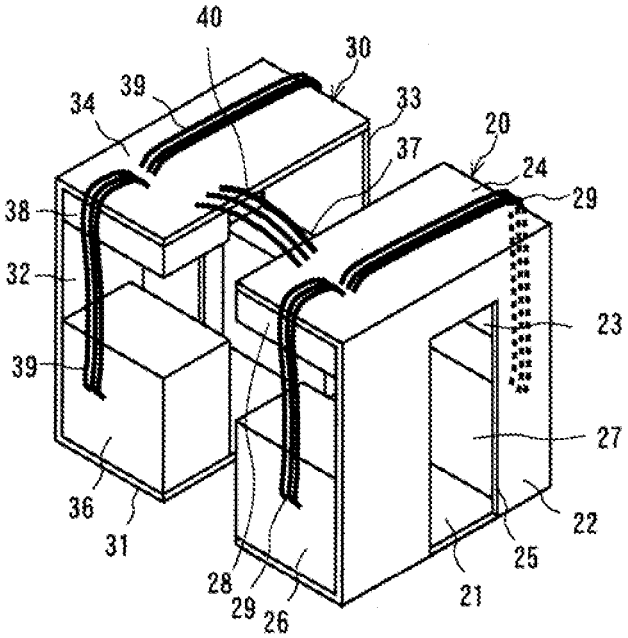
FIG. 2 is a perspective view showing a first driver's cab device unit and a second driver's cab device unit shown in FIG. 1.

First, a railcar 100 according to the present embodiment will be explained in reference to FIGS. 1 and 2. In the following explanations, terms regarding directions are used based on a viewpoint of a driver who performs driving operations in a driver's cab. For example, the term "front side" denotes a front direction from the viewpoint of the driver. FIG. 1 is a partially exploded perspective view showing the vicinity of a driver's cab 10 of the railcar 100. Various wires are not shown in FIG. 1. FIG. 2 is a perspective view showing a first driver's cab device unit 20 and a second driver's cab device unit 30. An obliquely lower left side in each of FIGS. 1 and 2 corresponds to the front side.

As shown in FIG. 1, the railcar 100 according to the present embodiment includes: a bodyshell 11 that forms an outer body of the railcar 100; and the driver's cab 10 arranged inside the bodyshell 11. The bodyshell 11 is formed by welding metal, such as stainless steel or aluminum. The bodyshell 11 is mainly constituted by: a tubular bodyshell main body 13 including an opening portion 12 formed at the front side; and an end bodyshell 14 that covers the opening portion 12 of the bodyshell main body 13. In the present embodiment, the end bodyshell 14 is configured to be detachable from the bodyshell main body 13. FIG. 1 shows a state where the end bodyshell 14 is detached from the bodyshell main body 13. A ceiling portion of the bodyshell main body 13 is formed in a circular-arc shape. A railcar-width-direction middle portion of the bodyshell main body 13 is higher than both end portions of the bodyshell main body 13.

The driver's cab 10 is mainly constituted by the first driver's cab device unit 20, the second driver's cab device unit 30, an interunit wire 40, an alignment member 50, and a back dividing plate 60. Hereinafter, these components will be explained in order.

The first driver's cab device unit 20 is a unit located at one of both railcar-width-direction sides in the driver's cab 10 (that is, at a right side on the sheet of FIG. 1). As shown in FIG. 2, the first driver's cab device unit 20 is formed in a box shape. After the first driver's cab device unit 20 is assembled outside the railcar, it is carried in the bodyshell main body 13. The first driver's cab device unit 20 includes a first driver's cab floor surface plate 21, a first driver's cab side plate 22, a first driver's cab back plate 23, and a first driver's cab ceiling plate 24, which form a part of an outer body of the driver's cab 10, the part being located at one railcar-width-direction side in the driver's cab 10. These plates 21 to 24 are formed by members having stiffness such that the first driver's cab device unit 20 can maintain the box shape. The members forming the plates 21 to 24 are not especially limited. For example, a composite plate formed by stacking a metal plate and a non-foamed resin plate can be used as each of the plates 21 to 24. The plates 21 to 24 are formed such that main surfaces thereof are rectangular. The first driver's cab side plate 22 includes an opening portion 25 to which a door through which crews get in and out of the railcar is attached.

A first driver's platform 26, a back device box 27, and a ceiling device box 28 are attached to the first driver's cab device unit 20. The first driver's platform 26 is located at a first driver's cab front area that is a front-side area of the first driver's cab device unit 20, and devices (hereinafter referred to as "first drivers cab front devices") are attached to or accommodated in the fast driver's platform 26. The back device box 27 is located at a first driver's cab hack area that is a back-side area of the first driver's cab device unit 20, and devices (hereinafter referred to as "first driver's cab back devices") are attached to or accommodated in the back device box 27. The ceiling device box 28 is located at a first driver's cab ceiling area that is a ceiling-side area of the first driver's cab device unit 20, and devices (hereinafter referred to as "first driver's cab ceiling devices") are attached to or accommodated in the ceiling device box 28. Hereinafter, the "first driver's cab front devices", the "first driver's cab back devices", and the "first driver's cab ceiling devices" are collectively called "first driver's cab devices". To be specific, the first driver's cab devices are distributedly arranged at a plurality of areas located at one railcar-width-direction side of the drivers cab 10.

Further, the first driver's cab device unit 20 includes a first driver's cab device wire 29 that connects the first driver's cab devices to one another. The first driver's cab device wire 29 connects not only the first driver's cab devices in the same area to one another but also the first driver's cab devices in the different areas to one another. The first driver's cab device wire 29 that connects the first driver's cab back device accommodated in the back device box 27 and the first driver's cab ceiling device accommodated in the ceiling device box 28 is arranged at a side surface (hereinafter simply referred to as a "rear surface"), located outside the driver's cab 10, of the first, driver's cab back plate 23 and a side surface (hereinafter simply referred to as a "rear surface"), located outside the driver's cab 10, of the first driver's cab ceiling plate 24. The first driver's cab device wire 29 that connects the first driver's cab front device attached to the first driver's platform 26 and the first driver's cab ceiling device accommodated in the ceiling device box 28 is arranged so as to extend along a front surface side of the first driver's cab device unit 20 and the rear surface of the first driver's cab ceiling plate 24. As above, the first driver's cab device wire 29 that connects the first driver's cab devices in the different areas to one another is arranged at the surface located outside the driver's cab 10. The reason why the first driver's cab device wire 29 can be included in the first driver's cab device unit 20 as above is because the first driver's cab device unit 20 includes the plates 21 to 24 that form a part of the outer body of the driver's cab 10. According to this configuration, the connecting work of the first driver's cab device wire 29 can be performed outside the railcar, so that the wire connecting work performed inside the railcar can be reduced.

The second driver's cab device unit 30 is a unit located at the other railcar-width-direction side in the driver's cab 10 (that is, at a left side on the sheet of FIG. 1). Specific devices and the like provided at the second driver's cab device unit 30 are different from those provided at the first driver's cab device unit 20, but the configuration of the second driver's cab device unit 30 is basically the same as that of the first driver's cab device unit 20. To be specific, the second driver's cab device unit 30 is formed in a box shape and can be assembled outside the railcar. The second driver's cab device unit 30 includes a second driver's cab floor surface plate 31, a second driver's cab side plate 32, a second driver's cab back plate 33, and a second driver's cab ceiling plate 34 which form a part of the outer body of the driver's cab 10, the part being located at the other railcar-width-direction side in the driver's cab 10.

A second driver's platform 36, a back device box 37, and a ceiling device box 38 are attached to the second driver's cab device unit 30. The second driver's platform 36 is located at a second driver's cab front area that is a front-side area of the second driver's cab device unit 30, and devices (hereinafter referred to as "second driver's cab front devices") are attached to or accommodated in the second driver's platform 36. The back device box 37 is located at a second driver's cab back area that is a back-side area of the second driver's cab device unit 30, and devices (hereinafter referred to as "second driver's cab back devices") are attached to or accommodated in the back device box 37. The ceiling device box 38 is located at a first driver's cab ceiling area that is a ceiling-side area of the second driver's cab device unit 30, and devices (hereinafter referred to as "second driver's cab ceiling devices") are attached to or accommodated in the ceiling device box 38. Hereinafter, the "second driver's cab front devices", the "second driver's cab back devices", and the "second driver's cab ceiling devices" are collectively called "second driver's cab devices". To be specific, the second driver's cab devices are distributedly arranged at a plurality of areas located at the other railcar-width-direction side of the driver's cab 10.

Further, the second driver's cab device unit 30 includes a second driver's cab device wire 39 that connects the second driver's cab devices to one another. The second driver's cab device wire 39 connects not only the second driver's cab devices in the same area to one another but also the second driver's cab devices in the different areas to one another. The second driver's cab device wire 39 that connects the second driver's cab device accommodated in the back device box 37 and the second driver's cab device accommodated in the ceiling device box 38 is arranged at a side surface (hereinafter simply referred to as a "rear surface"), located outside the driver's cab 10, of the second driver's cab back plate 33 and a side surface (hereinafter simply referred to as a "rear surface"), located outside the driver's cab 10, of the second driver's cab ceiling plate 34. The second driver's cab device wire 39 that connects the second driver's cab device attached to the second driver's platform 36 and the second driver's cab device accommodated in the ceiling device box 38 is arranged so as to extend along a front surface side of the second driver's cab device unit 30 and the rear surface of the second driver's cab ceiling plate 34.

The interunit wire 40 is a wire that connects the first driver's cab device attached in the first driver's cab device unit 20 and the second driver's cab device attached in the second driver's cab device unit 30. In the present embodiment, the interunit wire 40 is arranged so as to extend between an upper surface of the first driver's cab device unit 20 and an upper surface of the second driver's cab device unit 30. In the present embodiment, the interunit wire 40 is formed in an arc shape that projects upward but may be formed to sag downward. A general-purpose electric wire is used as the interunit wire 40, and the interunit wire 40 has flexibility.

The alignment member 50 is a member arranged between the first driver's cab device unit 20 and the second driver's cab device unit 30. The alignment member 50 is mainly constituted by a floor surface alignment member 51 located at the floor surface side and a ceiling alignment member 52 located at the ceiling side. The floor surface alignment member 51 forms a passage of the driver's cab 10, and the ceiling alignment member 52 forms a ceiling of the passage. Each of the floor surface alignment member 51 and the ceiling alignment member 52 is formed in a plate shape such that main surfaces thereof are rectangular. The first driver's cab device unit 20 tightly contacts one of both railcar-width-direction edge sides of the floor surface alignment member 51 (that is, a right side on the sheet of FIG. 1) and one of both railcar-width-direction edge sides of the ceiling alignment member 52 (that is, a right side on the sheet of FIG. 1). The second driver's cab device unit 30 tightly contacts the other railcar-width-direction edge side of the floor surface alignment member 51 (that is, a left side on the sheet of FIG. 1) and the other railcar-width-direction edge side of the ceiling alignment member 52 (that is, a left side on the sheet of FIG. 1).

Each of the floor surface alignment member 51 and the ceiling alignment member 52 is configured such that a railcar-width-direction size thereof is equal to a distance between the first driver's cab device unit 20 and the second driver's cab device unit 30 in a completed state. To be specific, by causing the first driver's cab device unit 20 and the second driver's cab device unit 30 to tightly contact the railcar-width-direction edge sides of the floor surface alignment member 51 and the ceiling alignment member 52, the first driver's cab device unit 20 and the second driver's cab device unit 30 can be arranged with a predetermined distance therebetween without performing size measurement or the like. The alignment member 50 also serves as a stopper that prevents the first driver's cab device unit 20 and the second driver's cab device unit 30 from moving so as to get close to each other. In other words, in a case where the first driver's cab device unit 20 and the second driver's cab device unit 30 are configured to be movable, these units 20 and 30 can move so as to get close to each other by removing the alignment member 50. As above, in the present embodiment, the first driver's cab device unit 20 and the second driver's cab device unit 30 are not configured as a single rigid body, and the alignment member 50 is provided between the first driver's cab device unit 20 and the second driver's cab device unit 30. The units 20 and 30 are configured to be able to get close to each other by removing the alignment member 50. Effects obtained by this configuration will be described later.

The back dividing plate 60 is a member that separates the driver's cab 10 and a passenger room 15. A member used as the back dividing plate 60 is not especially limited. For example, a composite plate obtained by stacking a metal plate and a non-foamed resin plate can be used as the back dividing plate 60. The back dividing plate 60 includes an opening portion (not shown) to which a passage door between the driver's cab 10 and the passenger room 15 is attached. The back dividing plate 60 also functions as a standard of the positioning of the first driver's cab device unit 20 and the second driver's cab device unit 30 in the railcar longitudinal direction. Each of the first driver's cab device unit 20 and the second driver's cab device unit 30 is arranged so as to be spaced apart from the back dividing plate 60. With this, an installation space of the first driver's cab device wire 29 and the second driver's cab device wire 39 is secured.

Figure 3:
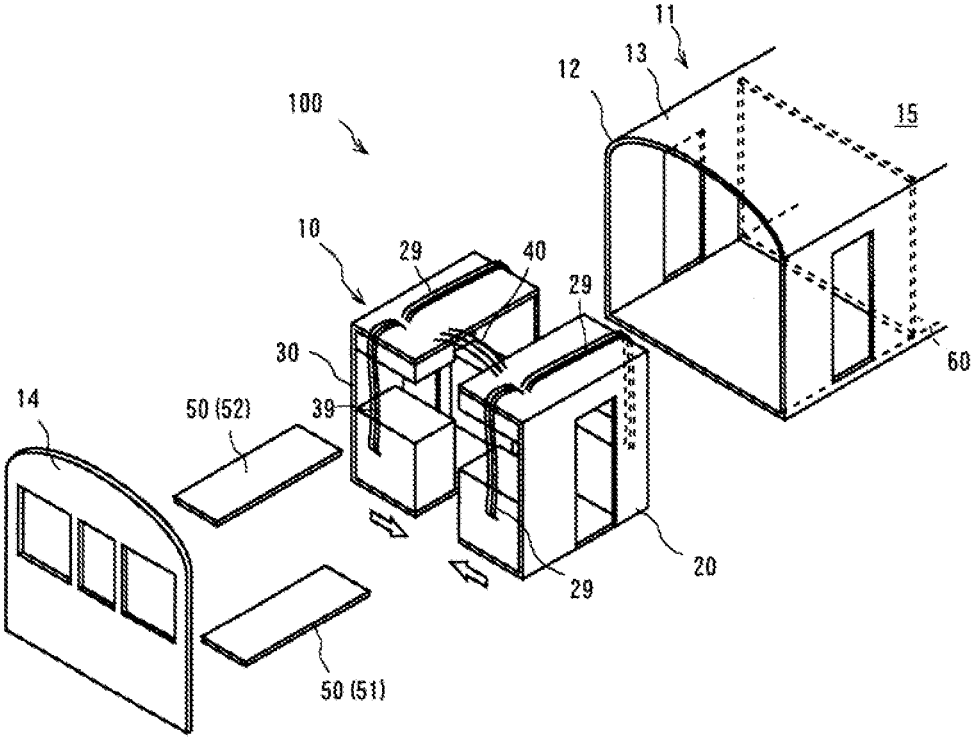
FIG. 3 is an exploded perspective view of the railcar shown in FIG. 1.

Next, a method of manufacturing the railcar 100 according to the present embodiment will be explained in reference to FIG. 3. FIG. 3 is an exploded perspective view of the railcar 100 according to the present embodiment. Here, the first driver's cab device unit 20 and the second driver's cab device unit 30 have already been assembled outside the railcar, and the units 20 and 30 have been coupled to each other by the interunit wire 40. In addition, as shown in FIG. 3, the end bodyshell 14 has been detached from the bodyshell main body 13.

First, as shown in FIG. 3, the back dividing plate 60 is provided at a predetermined position of the bodyshell main body 13. The back dividing plate 60 is carried in the bodyshell main body 13 through the opening portion 12. After the back dividing plate 60 is provided, the first driver's cab device unit 20 and the second driver's cab device unit 30 are carried in the bodyshell main body 13. Specifically, the first driver's cab device unit 20 and the second driver's cab device unit 30 are caused to get close to each other and then are carried in the bodyshell main both 13 in this state. As described above, the interunit wire 40 has flexibility. Therefore, even if the interunit wire 40 is distorted in some degree since the units 20 and 30 get close to each other, it does not break. Further, the interunit wire 40 is arranged so as to extend between the upper surface of the first driver's cab device unit 20 and the upper surface of the second driver's cab device unit 30. Therefore, the interunit wire 40 displaces upward or downward when the units 20 and 30 get close to each other.

The reason why the first driver's cab device unit 20 and the second driver's cab device unit 30 are caused to get close to each other is as below. Since the first driver's cab device unit 20 and the second driver's cab device unit 30 form the outer body including the side surfaces and ceiling of the driver's cab 10, the railcar-width-direction size and upper-lower direction size of each at the first driver's cab device unit 20 and the second driver's cab device unit 30 are extremely large. In contrast, the railcar-width-direction size and upper-lower direction size of an inner portion of the bodyshell 11 are not so large relative to the railcar-width-direction size and upper-lower direction size of the driver's cab 10. Regarding the railcar-width-direction size of the bodyshell 11, an inner frame (not shown) by which the units 20 and 30 are coupled to the bodyshell 11 projects from the bodyshell 11. In a case where the units 20 and 30 an directly carried in the bodyshell main body 13, they may contact the bodyshell main body 13. Regarding the upper-lower direction size of the bodyshell 11, both railcar-width-direction end portions of the bodyshell main body 13 are low in height. Therefore, in a case where the units 20 and 30 are directly carried in the bodyshell main body 13, they may contact the bodyshell main body 13. Here, in the present embodiment, the units 20 and 30 are caused to get close to each other and then are carried in the bodyshell main body 13 through a railcar-width-direction middle area of the bodyshell main body 13. In this case, comparatively large gaps are formed between each of the units 20 and 30 and each side surface a the bodyshell main body 13 and between each of the unit 20 and 30 and the ceiling portion of the bodyshell main body 13. Therefore, the risk of the contact between the bodyshell main body 13 and each of the units 20 and 30 decreases. Then, in order that the first driver's cab device unit 20 and the second driver's cab device unit 30 can be caused to get close to each other, in the present embodiment, the units 20 and 30 are not formed as a single rigid body, and the alignment member 50 is provided as a separate member between the units 20 and 30.

Next, after the first driver's cab device unit 20 and the second driver's cab device unit 30 are carried in the bodyshell main body 13, the units 20 and 30 are moved in order to increase an interval therebetween and are arranged so as to be located close to the side walls of the bodyshell main body 13, respectively. At this time, it is unnecessary to arrange the units 20 and 30 at predetermined exact positions. Then, each of the floor surface alignment member 51 and the ceiling alignment member 52 is inserted between the first driver's cab device unit 20 and the second driver's cab device unit 30. As described above, by causing the first driver's cab device unit 20 and the second driver's cab device unit 30 to tightly contact the railcar-width-direction edge sides of the floor surface alignment member 51 and the ceiling alignment member 52, the first driver's cab device unit 20 and the second driver's cab device unit 30 can be arranged with a predetermined distance therebetween. The length of the interunit wire 40 is determined in consideration of the size of the ceiling alignment member 52. Therefore, in a case where the distance between the first driver's cab device unit 20 and the second driver's cab device unit 30 corresponds to the ceiling alignment member 52, the interunit wire 40 does not sag downward so as to become an obstacle when providing the ceiling alignment member 52. On this account, the interunit wire 40 does not become an obstacle when providing the ceiling alignment member 52.

Next, the first driver's cab device unit 20 and the second driver's cab device unit 30 are fixed to the bodyshell main body 13, and minimum wire connecting work, such as connecting work of wires for power supply, between the driver's cab and the outside of the driver's cab is performed. Since the connecting work in the first driver's cab device unit 20, the connecting work in the second driver's cab device unit 30, and the connecting work between the units 20 and 30 have already been completed outside the railcar, these are unnecessary. As above, according to the present embodiment, since most of the wire connecting work that takes time does not have to be performed inside the railcar, work can be efficiently performed.

After the driver's cab 10 is formed as above, the opening portion 12 of the bodyshell main body 13 is finally closed by the end bodyshell 14, and the end bodyshell 14 is fixed to the bodyshell main body 13. After the other necessary assembling work, the railcar 100 is completed. The foregoing has explained the method of manufacturing the railcar 100 according to the present embodiment.

As above, a railcar according to the present embodiment is a railcar comprising a driver's cab, wherein: one of both railcar-width-direction portions of the driver's cab is formed by a first driver's cab device unit; the first driver's cab device unit includes at plurality of first driver's cab devices distributedly arranged in a plurality of areas located at one of both railcar-width-direction sides of the driver's cab, a first driver's cab device wire that connects the first driver's cab devices located in the different areas to one another, and a first driver's cab floor surface plate, a first driver's cab side plate, a first driver's cab back plate, and a first driver's cab ceiling plate, which form a part of an outer body of the driver's cab, the part being located at the one of both railcar-width-direction sides of the driver's cab; and these components of the first driver's cab device unit are integrated to form a box shape. As above, since the first driver's cab device unit includes a part of the outer body of the driver's cab, it can also include the first driver's cab device wire. Therefore, the connecting work of the first driver's cab device wire can be performed outside the railcar. On this account, the wire connecting work performed inside the railcar can be reduced.

Further, the present embodiment is configured such that: the other railcar-width-direction portion of the driver's cab is formed by a second drive's cab device unit; the second driver's cab device unit includes a plurality of second driver's cab devices distributedly arranged in a plurality of areas located at the other railcar-width-direction side of the driver's cab, a second driver's cab device wire that connects the second driver's cab devices located in the different areas to one another, and a second driver's cab floor surface plate, a second driver's cab side plate, a second driver's cab back plate, and a second driver's cab ceiling plate, which form as part of the outer body of the driver's cab, the part being located at the other railcar-width-direction side of the driver's cab; and these components of the second driver's cab device unit are integrated to form a box shape. According to this configuration, as with the first driver's cab device unit, the wire connecting work performed inside the railcar can be reduced.

The driver's cab includes an alignment member that is located between the first driver's cab device unit and the second driver's cab device unit forms a part of the outer body of the driver's cab, and is configured to prevent the first driver's cab device unit and the second driver's cab device unit from moving so as to get close to each other. As described above, since the alignment member is provided as a separate member formed separately from the first driver's cab device unit and the second driver's cab device unit (that is, since these units are not formed as a single rigid body), these units can be caused to get close to each other. As a result, these units can be easily carried in the bodyshell main body.

The driver's cab includes an interunit wire that connects the first driver's cab device and the second driver's cab device and is arranged so as to extend between an upper surface of the first driver's cab device unit and an upper surface of the second driver's cab device unit. According to this configuration, since the interunit wire is arranged so as to extend between the upper surface of the first driver's cab device unit and the upper surface of the second driver's cab device unit, the interunit wire does not become an obstacle when inserting the alignment member (ceiling alignment member).

The first driver's cab device unit is provided to tightly contact one of both railcar-width-direction edge sides of the alignment member, and the second driver's cab device unit is provided to tightly contact the other railcar-width-direction edge side of the alignment member. This is because the alignment member serves as a gauge. Thus, the positioning of the first driver's cab device unit and the second driver's cab device unit becomes easy.

The first driver's cab devices are distributedly arranged at at least a first driver's cab front area located at a front side of the first driver's cab device unit, a first driver's cab back area located at a side-surface side of the first driver's cab device unit, and a first driver's cab ceiling area located at a ceiling side of the first driver's cab device unit, and the first driver's cab device wire that connects the first driver's cab back device arranged at the first driver's cab back area and the first driver's cab ceiling device arranged at the first driver's cab ceiling area is arranged at side surfaces of the first driver's cab back plate and the first driver's cab ceiling plate, the side surfaces being located outside the driver's cab. As above, even in a case where the first drivers cab device wire is arranged at the side surface, located outside the driver's cab, of the first driver's cab back plate and the side surface, located outside the driver's cab, of the first driver's cab ceiling plate, the connecting work of the first driver's cab device wire can be performed outside the railcar.

The second driver's cab devices are distributedly arranged at at least a second driver's cab front area located at a front side of the second driver's cab device unit, a second driver's cab back area located at a back side of the second driver's cab device unit, and a second driver's cab ceiling area located at a ceiling side of the second driver's cab device unit, and the second driver's cab device wire that connects the second driver's cab back device arranged at the second driver's cab back area and the second driver's cab ceiling device arranged at the second driver's cab ceiling area is arranged at side surfaces of the second driver's cab back plate and the second driver's cab ceiling plate, the surfaces being located outside the driver's cab. Even in this case, the connecting work of the first driver's cab device wire can be performed outside the railcar.

The foregoing has explained the embodiment in reference to the drawings. However, specific configurations are not limited to the embodiment. Design changes and the like within the scope of the present invention are included in the present invention.

INDUSTRIAL APPLICABILITY

According to the present invention, when manufacturing a railcar, wire connecting work performed inside the railcar can be reduced. Therefore, the present invention is useful in the technical field of railcars.

REFERENCE SIGNS LIST

10 driver's cab
11 bodyshell
20 first driver's cab device unit
21 first driver's cab floor surface plate
22 first driver's cab side plate
23 first driver's cab back plate
24 first driver's cab ceiling plate
29 first driver's cab device wire
30 second driver's cab device unit
31 second driver's cab floor surface plate
32 second driver's cab side plate
33 second driver's cab back plate
34 second driver's cab ceiling plate
39 second driver's cab device wire
40 interunit wire
50 alignment member
100 railcar

The invention claimed is:

1. A railcar comprising:

a driver's cab including a first driver's cab device unit and a second driver's cab device unit, the first driver's cab device unit and the second driver's cab device unit forming at least two railcar-width-direction portions of the driver's cab, the first driver's cab device unit and the second driver's cab device unit being modular;

the first driver's cab device unit including:

a plurality of first driver's cab devices disposed in a plurality of areas in the first driver's cab device unit, a first driver's cab device wire that connects the first driver's cab devices located in the different areas to one another, and a first driver's cab floor surface plate, a first driver's cab side plate, a first driver's cab back plate, and a first driver's cab ceiling plate forming an outer body of the first driver's cab device unit; and the plurality of first driver's cab devices, the first driver's cab device wire, the first driver's cab floor surface plate, the first driver's cab side plate, the first driver's cab back plate, and the first driver's cab ceiling plate are integrated to form a box shape.

2. The railcar according to claim 1, wherein:

the second driver's cab device unit includes:

a plurality of second driver's cab devices disposed in a plurality of areas in the second driver's cab device unit, a second driver's cab device wire that connects the second driver's cab devices located in the different areas in the second driver's cab device unit to one another, and a second driver's cab floor surface plate, a second driver's cab side plate, a second driver's cab back plate, and a second driver's cab ceiling plate, which form an outer body the second driver's cab device unit; and the plurality of second driver's cab devices, the second driver's cab device wire, the second driver's cab floor surface plate, the second driver's cab floor surface plate, the second driver's cab side plate, the second driver's cab back plate and the second driver's cab ceiling plate are integrated to form a box shape.

3. The railcar according to claim 2, wherein the driver's cab includes an alignment member that is located between the first driver's cab device unit and the second driver's cab device unit, forms a part of the outer body of the driver's cab, and is configured to prevent the first driver's cab device unit and the second driver's cab device unit from moving so as to get close to each other.

4. The railcar according to claim 3, wherein:

the first driver's cab device unit is provided to tightly contact one of both railcar-width-direction edge sides of the alignment member; and the second driver's cab device unit is provided to tightly contact the other railcar-width-direction edge side of the alignment member.

5. The railcar according to claim 2, wherein the driver's cab includes an interunit wire that connects the first driver's cab device and the second driver's cab device and is arranged so as to extend between an upper surface of the first driver's cab device unit and an upper surface of the second driver's cab device unit.

6. The railcar according to claim 2, wherein:

the second driver's cab devices are disposed at least a second driver's cab front area located at a front side of the second driver's cab device unit, a second driver's cab back area located at a back side of the second driver's cab device unit, and a second driver's cab ceiling area located at a ceiling side of the second driver's cab device unit; and the second driver's cab device wire that connects the second driver's cab back device arranged at the second driver's cab back area and the second driver's cab ceiling device arranged at the second driver's cab ceiling area is arranged at surfaces of the second driver's cab back plate and the second driver's cab ceiling plate, the surfaces being located outside the driver's cab.

7. The railcar according to claim 1, wherein:

the first driver's cab devices are disposed at least a first driver's cab front area located at a front side of the first driver's cab device unit, a first driver's cab back area located at a back side of the first driver's cab device unit, and a first driver's cab ceiling area located at a ceiling side of the first driver's cab device unit; and the first driver's cab device wire that connects the first driver's cab back device arranged at the first driver's cab back area and the first driver's cab ceiling device arranged at the first driver's cab ceiling area is arranged at surfaces of the first driver's cab back plate and the first driver's cab ceiling plate, the surfaces being located outside the driver's cab.

* * * * *